US006039495A

United States Patent [19]

Zimmerman et al.

[11] Patent Number: 6,039,495

[45] Date of Patent: Mar. 21, 2000

[54] STORAGE PAGE FOR THREE-DIMENSIONAL ITEMS

[75] Inventors: Julie G. Zimmerman, Draper; Alex W. Jacobsen, Stansbury Park, both of Utah

[73] Assignee: Kallman Corporation, West Jordan, Utah

[21] Appl. No.: 09/054,659

[22] Filed: Apr. 3, 1998

[51] Int. Cl.[7] ..... B42F 13/00; B65D 73/00; A47G 1/06

[52] U.S. Cl. ..... 402/79; 281/38; 281/22; 206/463; 206/467; 206/470; 206/461; 40/726; 40/771; 40/772

[58] Field of Search ..... 402/79; 281/38, 281/22; 206/467, 469, 470, 471, 463, 425, 472, 461, 488; 40/771, 772, 726

[56] References Cited

U.S. PATENT DOCUMENTS

| | | | |
|---|---|---|---|
| 3,394,802 | 7/1968 | Hershaft | 206/78 |
| 3,635,335 | 2/1971 | Kramer | 206/82 |
| 3,645,384 | 2/1972 | Wind | 206/471 |
| 3,659,706 | 5/1972 | Serrell | 206/56 |
| 3,685,717 | 8/1972 | Seifert et al. | 229/2.5 |
| 3,776,375 | 12/1973 | Rohdin | 206/459.5 |
| 3,972,417 | 8/1976 | Iten et al. | 206/354 |
| 4,058,207 | 11/1977 | Koltz | 229/102.5 |
| 4,091,927 | 5/1978 | Lunsford | 206/459.5 |
| 4,153,162 | 5/1979 | Samsing | 206/476 |
| 4,215,499 | 8/1980 | Wilson | 40/158 |
| 4,427,129 | 1/1984 | Wyslotsky et al. | 220/306 |
| 4,427,705 | 1/1984 | Wyslotsky et al. | 229/43 |
| 4,498,589 | 2/1985 | Scott et al. | 206/527 |
| 4,779,734 | 10/1988 | Kydonieus | 206/470 |
| 4,884,691 | 12/1989 | Behrens et al. | 206/444 |
| 5,119,574 | 6/1992 | King | 40/537 |
| 5,143,215 | 9/1992 | Hartley et al. | 206/705 |
| 5,150,787 | 9/1992 | Bird et al. | 206/329 |
| 5,150,792 | 9/1992 | Munroe | 206/486 |
| 5,169,014 | 12/1992 | Hexamer | 229/2.5 |
| 5,199,745 | 4/1993 | Balsamo | 283/117 |
| 5,294,279 | 3/1994 | Kuhns et al. | 156/324.4 |
| 5,297,679 | 3/1994 | Rondone et al. | 206/468 |
| 5,338,125 | 8/1994 | Forsee et al. | 402/46 |
| 5,353,935 | 10/1994 | Yeager et al. | 206/470 |
| 5,377,836 | 1/1995 | Eisenbraun | 206/461 |
| 5,390,792 | 2/1995 | Van Ness et al. | 206/439 |
| 5,600,939 | 2/1997 | Giovannone | 53/559 |
| 5,603,408 | 2/1997 | Protz, Jr. | 206/461 |
| 5,722,536 | 3/1998 | Pierce et al. | 206/5.1 |
| 5,775,516 | 7/1998 | Mc Cumber et al. | 206/470 |
| 5,785,180 | 7/1998 | Dressel et al. | 206/532 |

*Primary Examiner*—Willmon Fridie, Jr.
*Assistant Examiner*—Alisa L. Thurston
*Attorney, Agent, or Firm*—Prince, Yates & Geldzahler

[57] ABSTRACT

A storage page for a three-ring binder or the like has a plurality of three-dimensional cavities for storing and displaying three-dimensional objects. The storage page is constructed of a clear plastic material sufficiently rigid to maintain its shape. In a preferred embodiment, the three-dimensional cavities are defined by raised sections in the front sheet of the storage page, the raised sections generally defined by a planar wall parallel to the front sheet, and one or more walls normal thereto to form a three-dimensional pocket. The back sheet of the storage page includes identically shaped and mating indentations that cooperate with the three-dimensional pockets of the front sheet of the storage page to define the three-dimensional cavity. An opaque matte may be sandwiched between the front and back sheets of the storage page, the matte being used for backing or contrast, and also in a writing surface for labeling and other indicia the contents of the individual three-dimensional cavities. The front and back sheets are held together by a unique attachment mechanism, which is also used to secure the perimeters of the individual three-dimensional cavities formed on the front and back sheets together. Alternative embodiments of the present invention comprise the front and back sheets attached together by a living hinge, and the three-dimensional pockets being formed in both the front and back storage page sheets. An additional alternative embodiment comprises individual three-dimensional cavities that are peal-and-stick mountable on individual pieces of card stock, plastic, or other backing material suitable for mounting in a three-ring binder or other binder or on wall boards, in picture frames, etc.

15 Claims, 8 Drawing Sheets

STORAGE PAGE FOR THREE-DIMENSIONAL ITEMS

BACKGROUND OF THE INVENTION

1. Field of the Invention

This invention relates to a storage page for a three-ring binder, for example, for holding and displaying three-dimensional objects, and more particularly relates to such a storage page having three-dimensional storage cavities therein for storing and displaying the three-dimensional objects.

2. Description of the Prior Art

Photo album storage pages are well known. A typical album photo storage page comprises a semi-rigid base material (plastic or cardboard), having a transparent front and back plastic material that magnetically or statically attaches to the base in a manner to sandwich a photograph or photographs therebetween to hold the photographs in place on the page for viewing. Other photo album pages, as shown in U.S. Pat. Nos. 4,442,762 and Des. 277,490 comprise transparent plastic sheets sealed around selected edges thereof in order to define transparent pockets for holding and displaying photographs therein. Similar album pages, as in U.S. Des. Pat. No. 353,837, also comprising multiple transparent plastic sheets having individual heat-sealed pockets, are used for holding and displaying other two dimensional items. Still other album pages, as in U.S. Pat. No. 5,316,404 have expandable, flexible pockets, specifically for holding a stacked group of photographs in a manner to retain the stacked photographs within the pocket, yet permit easy withdrawal of the group for individual viewing. Other ring binders and binder pages, as in U.S. Pat. Nos. 5,417,509 and 4,629,349, include transparent pockets formed therewith for holding and/or displaying two-dimensional objects. Lastly, there exist three-dimensional packages for holding audio tapes, video tapes, compact disks, etc. in combination with two dimensional articles, as in U.S. Pat. No. 4,290,524, and in combination with typical album pages for holding single photographs, as in U.S. Pat. No. 5,161,907.

OBJECTS OF THE INVENTION

It is an object of the present invention to provide a storage page for an album or the like, the storage page having at least one three-dimensional cavity for storing and displaying three-dimensional objects.

It is a further object of the present invention to provide such a storage page having three-dimensional cavities wherein the cavities are tightly closable for retaining three-dimensional objects loosely therein.

It is a still further object of the present invention to provide such a storage page wherein the three-dimensional cavities are easily accessible for inserting and removing three-dimensional objects.

SUMMARY OF THE INVENTION

A storage page for a three-ring binder or the like has a plurality of three-dimensional cavities for storing and displaying three-dimensional objects. The storage page is constructed of a clear plastic material sufficiently rigid to maintain its shape. In a preferred embodiment, the three-dimensional cavities are defined by raised sections in the front sheet of the storage page, the raised sections generally defined by a planar wall parallel to the front sheet, and one or more walls normal thereto to form a three-dimensional pocket. The back sheet of the storage page includes identically shaped and mating indentations that cooperate with the three-dimensional pockets of the front sheet of the storage page to define the three-dimensional cavity. An opaque matte may be sandwiched between the front and back sheets of the storage page, the matte being used for backing or contrast, and also is a writing surface for labeling or other indicia for the contents of the individual three-dimensional cavities. The front and back sheets are held together by a unique attachment mechanism, which is also used to secure the perimeters of the individual three-dimensional cavities formed by the front and back sheets.

Alternative embodiments of the present invention comprise the front and back sheets attached together by a living hinge, and the three-dimensional pockets being formed in both the front and back storage page sheets. An additional alternative embodiment comprises individual three-dimensional cavities that are peal-and-stick mountable on individual pieces of card stock, plastic, or other backing material suitable for mounting in a three-ring binder or other binder or on wall boards, in picture frames, etc.

DETAILED DESCRIPTION OF THE INVENTION

Figure 1:
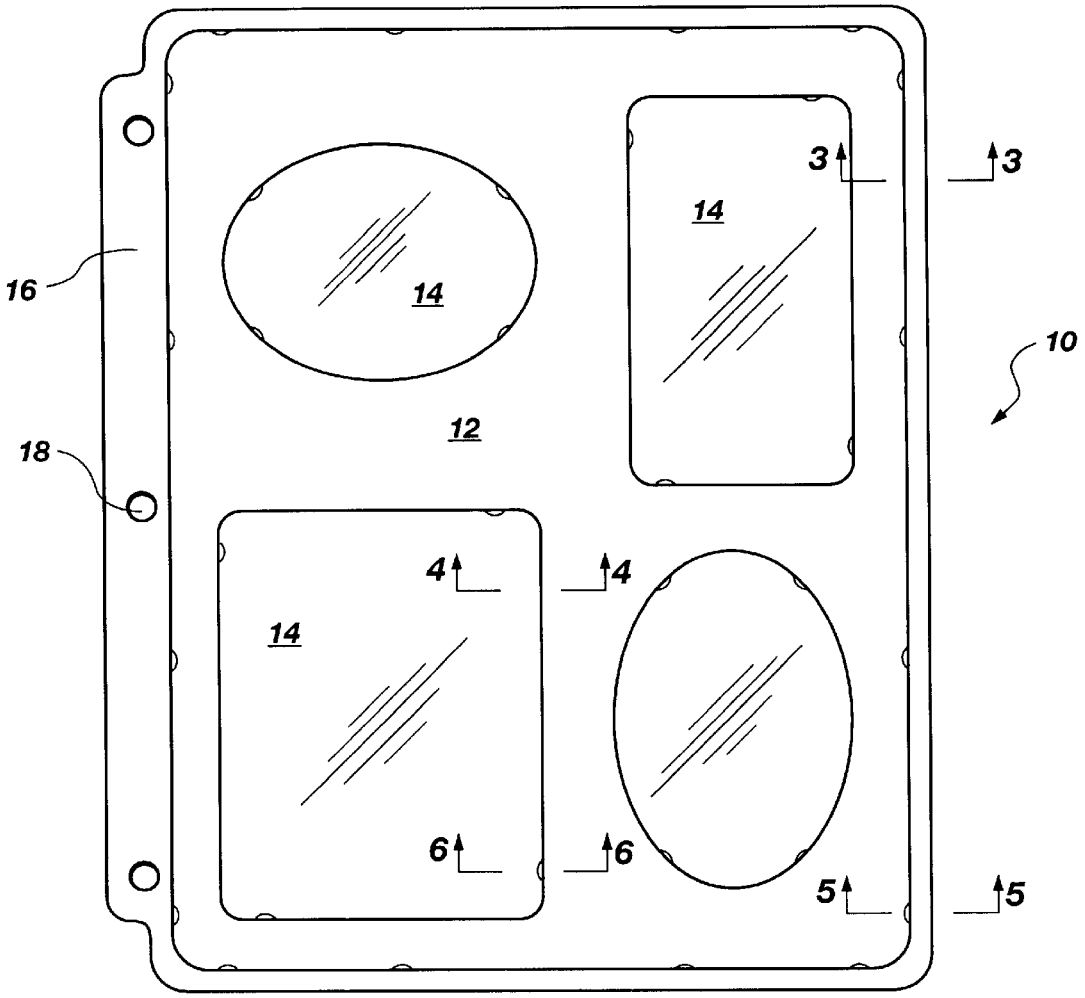
FIG. 1 is a front view of a storage page of the present invention illustrating a plurality of various shaped three-dimensional cavities.

Turning now to the drawings, and initially to FIG. 1, a storage page for a three-ring binder having a plurality of three-dimensional cavities for storing and displaying three-dimensional objects is shown in plan view, generally illustrated by the numeral 10. The storage page 10 has a front generally planar section 12 and a plurality of three-dimensional cavities 14. These three-dimensional cavities are better illustrated with reference to the various perspective figures herein. The storage page front generally planar section 12 also includes a binder tab 16, formed generally planar therewith, the binder tab including a plurality of holes 18 for binding the storage page in a three-ring binder, for instance, or in a post-type binder, as will be explained in greater detail hereinbelow. The construction material of the preferred embodiment is sheet 0.020"(±0.005") thick PETG. However, any transparent semi-rigid plastic film such as polyethylene, PVC, polypropylene, etc. can be used.

Figure 2:
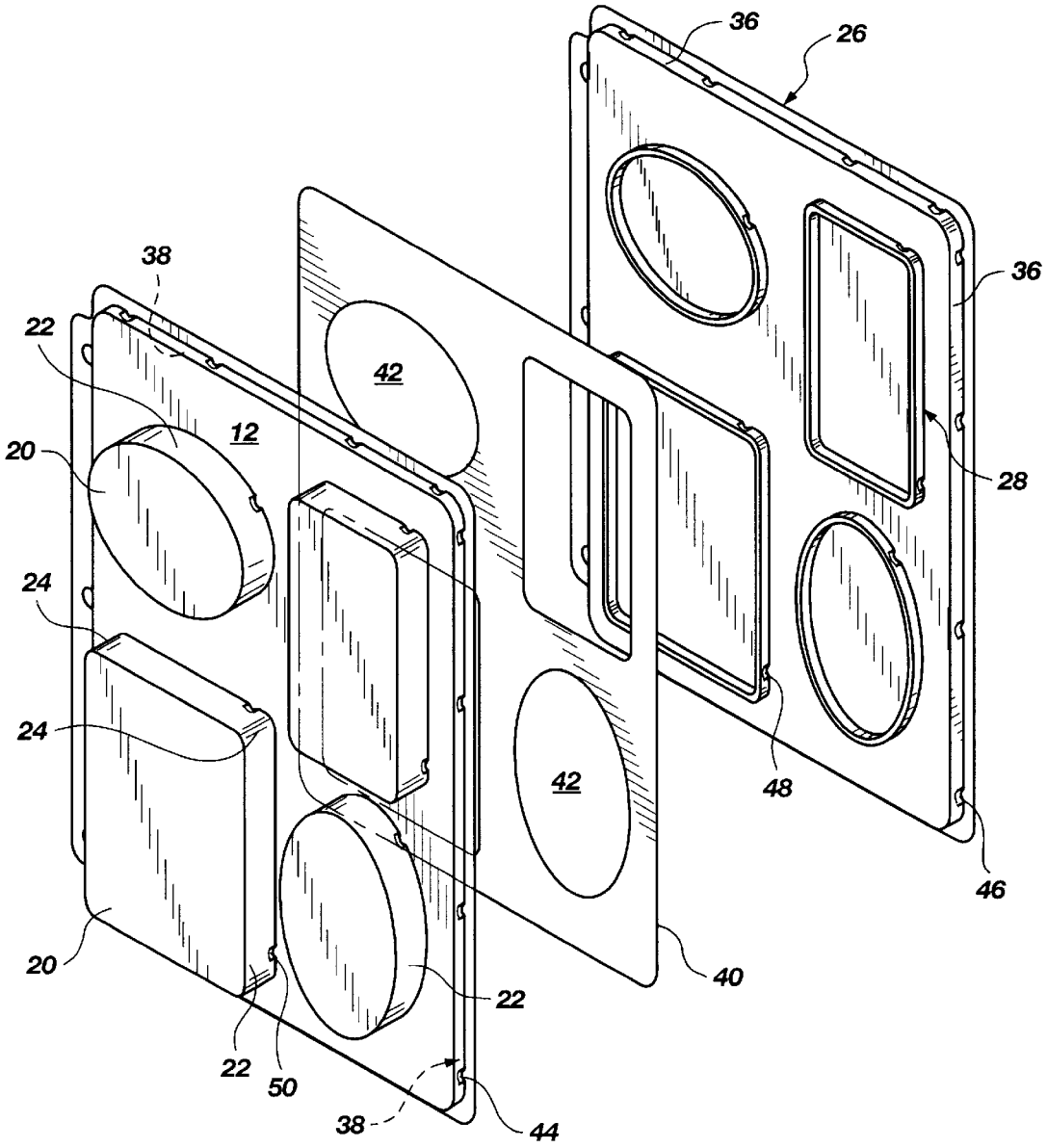
FIG. 2 is a perspective exploded view of a storage page as shown in FIG. 1.

FIG. 2 better illustrates the first embodiment of the storage page of the present invention. This storage page comprises the front generally planar section 12 having the various three-dimensional pockets 14 therein, and illustrates that these three-dimensional pockets are preferably approximately one-half to one inch deep. These individual three-dimensional pockets 14 each comprise a planar front wall 20 and one or more side walls 22. As appreciated, those three-dimensional pockets having rounded or circular front walls (i.e., circular, oval, elliptical, etc. pockets) have a single rounded and continuous side wall 22, whereas other three-dimensional pockets of various shapes have one or more side walls 22 joined together at intersecting corners 24.

Figure 4:
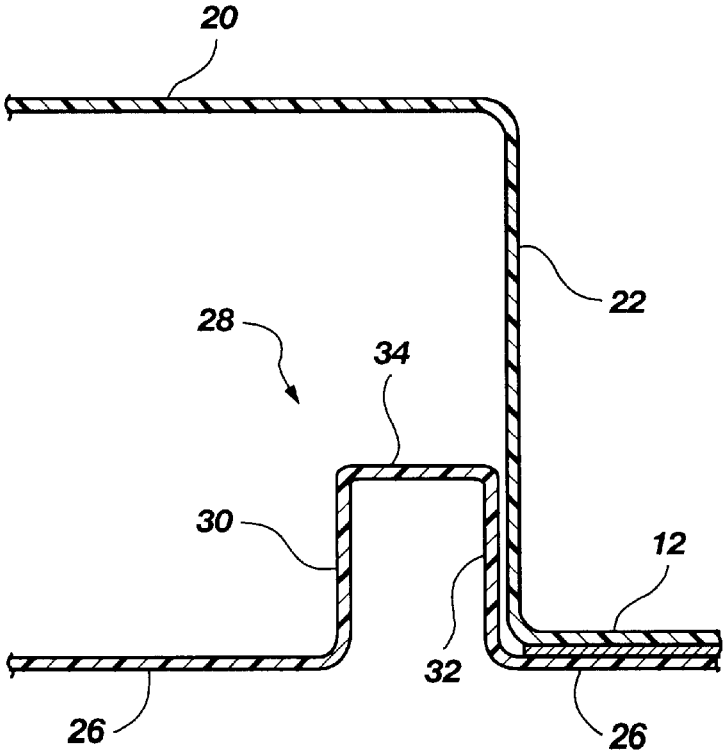
FIG. 4 is a partial sectional view taken along the lines 4—4 in FIG. 1.

FIG. 2 also illustrates the second or rear generally planar section 26 that mates with the first (front) generally planar section 12 to define the various three-dimensional cavities. These various cavities are defined on the rear planar section 26 by a plurality of raised ledges 28 that are sized and configured to snugly fit inside respective front section pocket side walls 22 to define the three-dimensional cavities. These raised ledges 28 are better shown in FIG. 4 to comprise inner and outer vertical walls 30 and 32, each wall transitioning into the common top surface 34. Using a circular three-dimensional cavity for purposes of explanation, the circumference of the outer vertical wall 32 of the back planar section 26 is sized to snugly fit inside the circumference of the mating circular three-dimensional pocket side wall 22 of the front planar section 12. In this manner, a friction-fit between the two surfaces will aid in retaining the two planar sections together.

Figure 3:
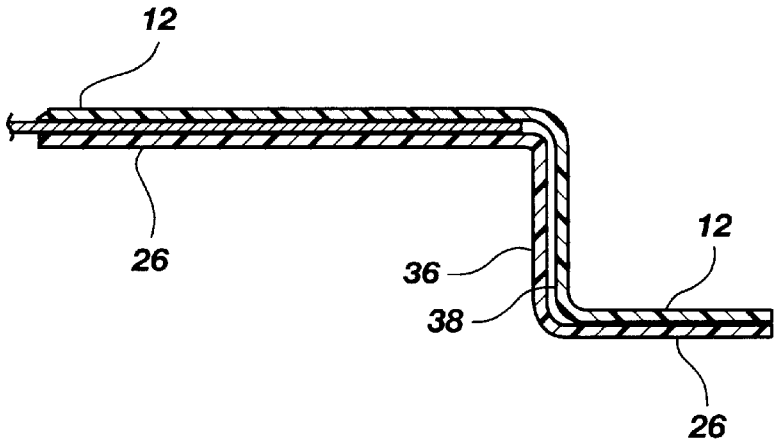
FIG. 3 is a partial sectional view taken along the lines 3—3 in FIG. 1.

FIGS. 2 and 3 also illustrate an additional retaining mechanism for retaining the front and back planar sections 12 and 26 together. This retaining mechanism takes the form of a perimeter ledge 36 around the perimeter of the back planar section 26 that is sized and configured to be similar to the raised ledges 28 that define the plurality of three-dimensional cavities on the rear planar section 26. This back planar section perimeter ledge 36 cooperates with a mating perimeter channel 38 on the front planar section 12 in a manner to retain the two planar sections together by friction fit between the back planar section perimeter ledge 36 and front planar section perimeter channel 38.

The details of the mating perimeter ledge 36 and perimeter channel 38 are better shown in FIG. 3, which is a partial sectional view taken through the lines 3—3 in FIG. 1 cutting through the mating perimeter ledge and channel. FIG. 3 illustrates the mating perimeter ledge 36 and channel 38 along the right side of the storage page, as shown in FIG. 1, it being understood that an oppositely formed perimeter ledge and channel 36 and 38 are formed on the left side of the storage page and along the top and bottom of the storage page. In this manner, frictional resistance between the perimeter ledge and channel retains the front planar section 12 in functional position against the back planar section 26.

As shown in FIG. 2, the storage page also includes an opaque matte 40 having apertures or cutouts 42 therein that are sized and configured to permit the matte to be sandwiched between the front planar section 12 and back planar section 26 in a manner to highlight the contents of the various three-dimensional cavities. As can be appreciated, the outside perimeter of the opaque matte 40 is slightly smaller than the front planar section perimeter channel 38 to enable the matte to be sandwiched between the two planar sections. Likewise, the various cutouts 42 are slightly larger than the outside vertical surfaces 32 of the respective raised ledges 28 on the back planar section 26, again in order to permit the matte to fit down flush against the back planar section 26. The preferred material for this opaque matte 40 is a Ph-neutral paper stock. Preferably, opaque mattes are provided in a number of colors and textures, most permitting the user to write on the matte adjacent respective three-dimensional cavities personalized information or indicia regarding contents of the particular three-dimensional cavity.

Figure 5:
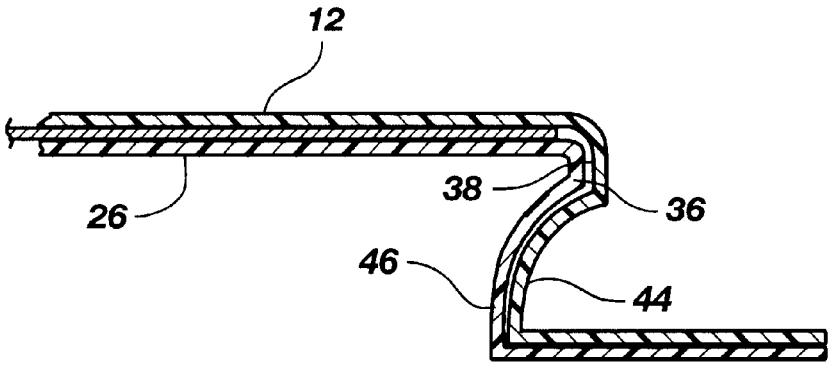
FIG. 5 is a partial sectional view taken along the lines 5—5 in FIG. 1.
Figure 6:
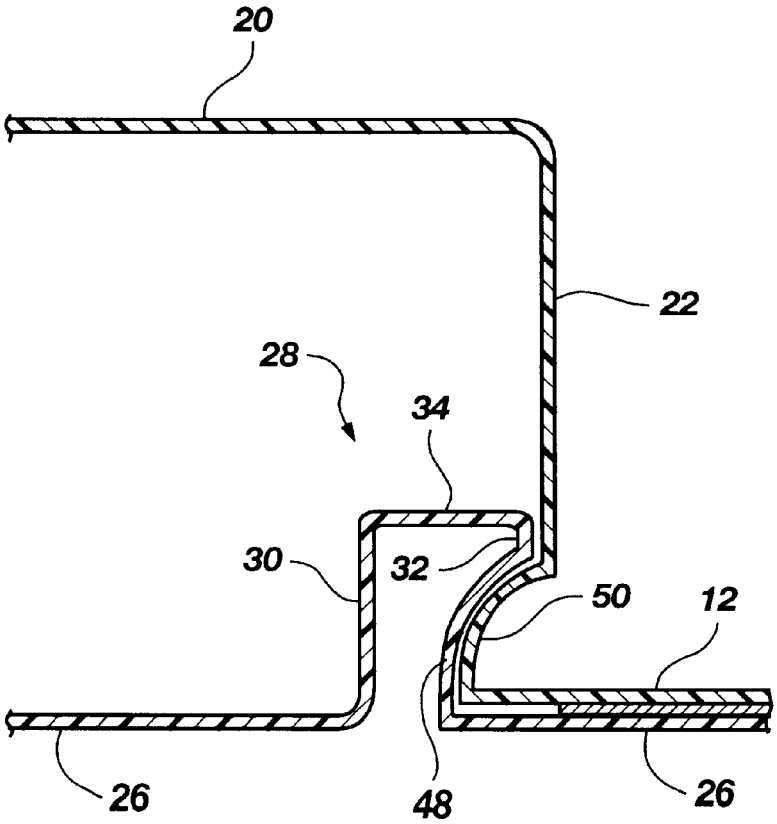
FIG. 6 is a partial sectional view taken along the lines 6—6 in FIG. 1.

FIGS. 5 and 6 illustrate an enhancement to the locking mechanism for attaching the front planar section 12 to the back planar section 26 to define the plurality of closed three-dimensional cavities therebetween. Specifically, FIG. 5 is a partial sectional view taken through the areas of cooperating projections and indentations formed in the perimeter channels 38 of the front planar section 12 and the perimeter ledges 36 of the back planar section 26. As shown, the front planar section perimeter channel 38 includes a semi-conical concave-shape projection 44 that is adapted to fit into a semi-conical convex-shaped indentation 46 formed on the inside of the back planar perimeter channel 36. Each of these indentations 46 and cooperating projections 44 is essentially semi-conical in shape and approximately as wide as it is high, and approximately a half width deep. FIGS. 1 and 2 illustrate that a plurality of these sets of locking projections 44 and indentations 46 are formed along each of the four sides of the front and back planar sections for securely locking the two planar sections together. Those skilled in the art can therefore readily appreciate that the front planar section 12 can be easily slipped down directly over the back planar section 26, thereby aligning and slipping respective front planar section perimeter channel semi-conical projections 44 into respective back planar section perimeter ledge semi-conical indentations 46. With these respective projections 44 in functional position within respective indentations 46, they function to retain the front planar section 12 in position on top of and against the back planar section 26.

FIG. 6 illustrates essentially identical retaining indentations and projections formed along the perimeters of the respective three-dimensional cavity raised ledges 28 on the back (bottom) planar section 26 and corresponding three-dimensional pocket side walls 22 formed in the front (top) planar section 12. Specifically, the back planar section raised ledges 28 are formed with a plurality of semi-conical shaped indentations 48, specifically formed in the raised ledge outer vertical walls 32. These semi-conical indentations 48 are adapted to receive therein cooperating semi-conical projections 50 formed in the three-dimensional pocket planar side walls 22 of the various three-dimensional pockets. These cooperating semi-conical projections 50 and indentations 48 cooperate to "lock" the three-dimensional pocket side walls 22 of the upper planar section 12 down and around respective raised ledges 28 on the back planar section 26 to define the specific three-dimensional cavities. FIGS. 1 and 2 illustrate that at least one set of locking projections 50 and indentations 48 is formed on each side of a multi-sided (i.e., rectangular) three-dimensional cavity, preferably adjacent a corner 24. Such placement of the three-dimensional cavity front and back locking mechanism improves the locking efficiency due to its proximity to the more rigid corner 24.

Inasmuch as the individual front and back planar sections of the storage page 10 are formed of a thin plastic material, it will be understood that the resiliency provided by the plastic material enables the respective cooperating projections to deform slightly to "snap" into place within respective indentations in order to retain the front planar section three-dimensional pocket side walls 22 down and against the respective back planar section raised ledge outer vertical wall 32 in order to maintain the defined three-dimensional cavity.

Figure 7:
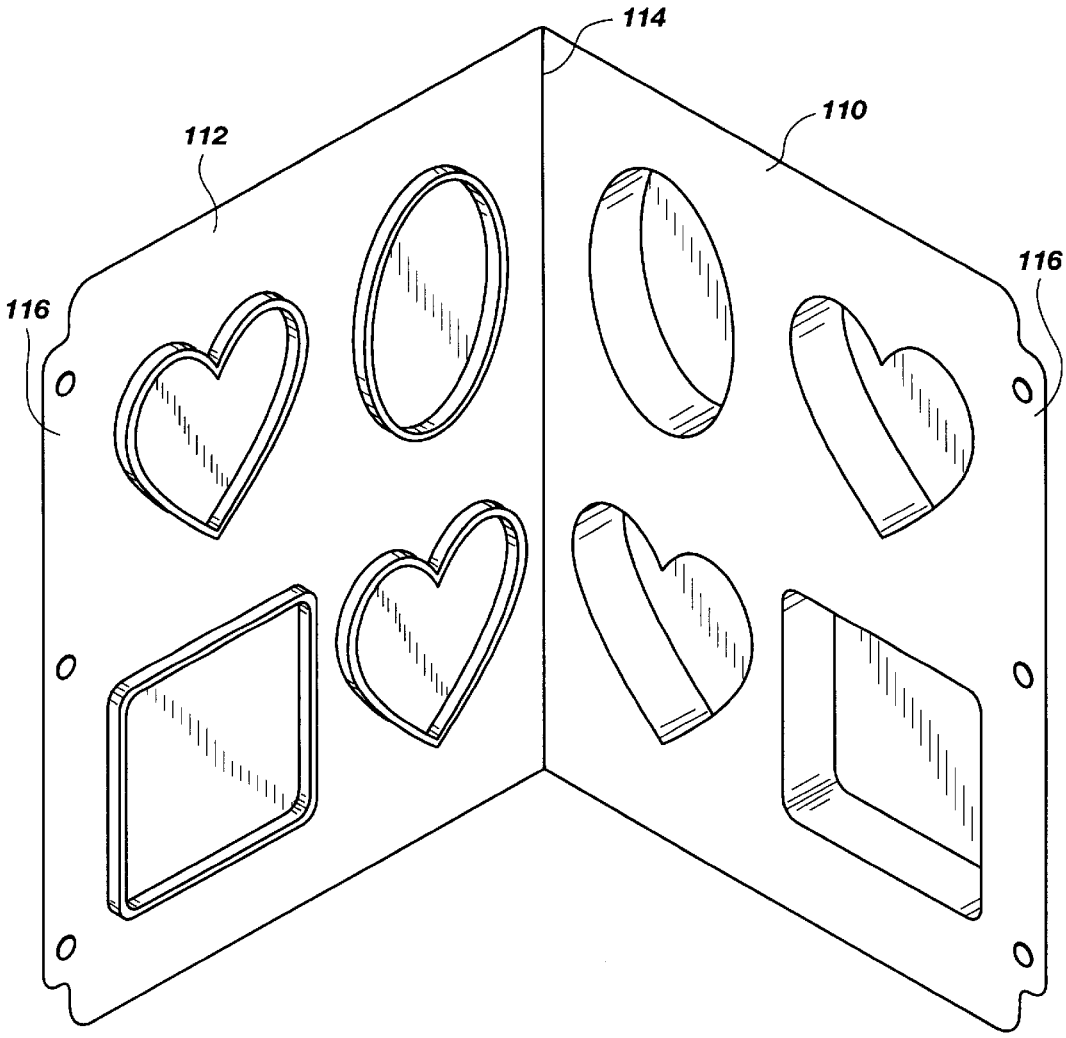
FIG. 7 is a perspective view of a second embodiment of the storage page of the present invention.

FIG. 7 is a perspective view of a second embodiment of the storage page of the present invention illustrating both front and back planar sections formed of a single piece of clear plastic material. In the embodiment shown in FIG. 7, the front section is indicated at 110 and the back section is indicated at 112, with a living hinge 114 formed therebetween to enable the two planar sections to be folded together. In all other respects, the construction of the front planar section 110 is identical to that of the front planar section 12 of the first embodiment, except for replacement of the perimeter channel along the edge opposite the binder tab 16 with the living hinge 114. FIG. 7 also illustrates the use of a variety of shapes and configurations for the various three-dimensional cavities which can be used with the storage page of the present invention. Although not shown in FIG. 7, this embodiment will also accept the Ph-neutral paper stock opaque matte 40, as in the matte 40 shown and described hereinabove.

Figure 8:
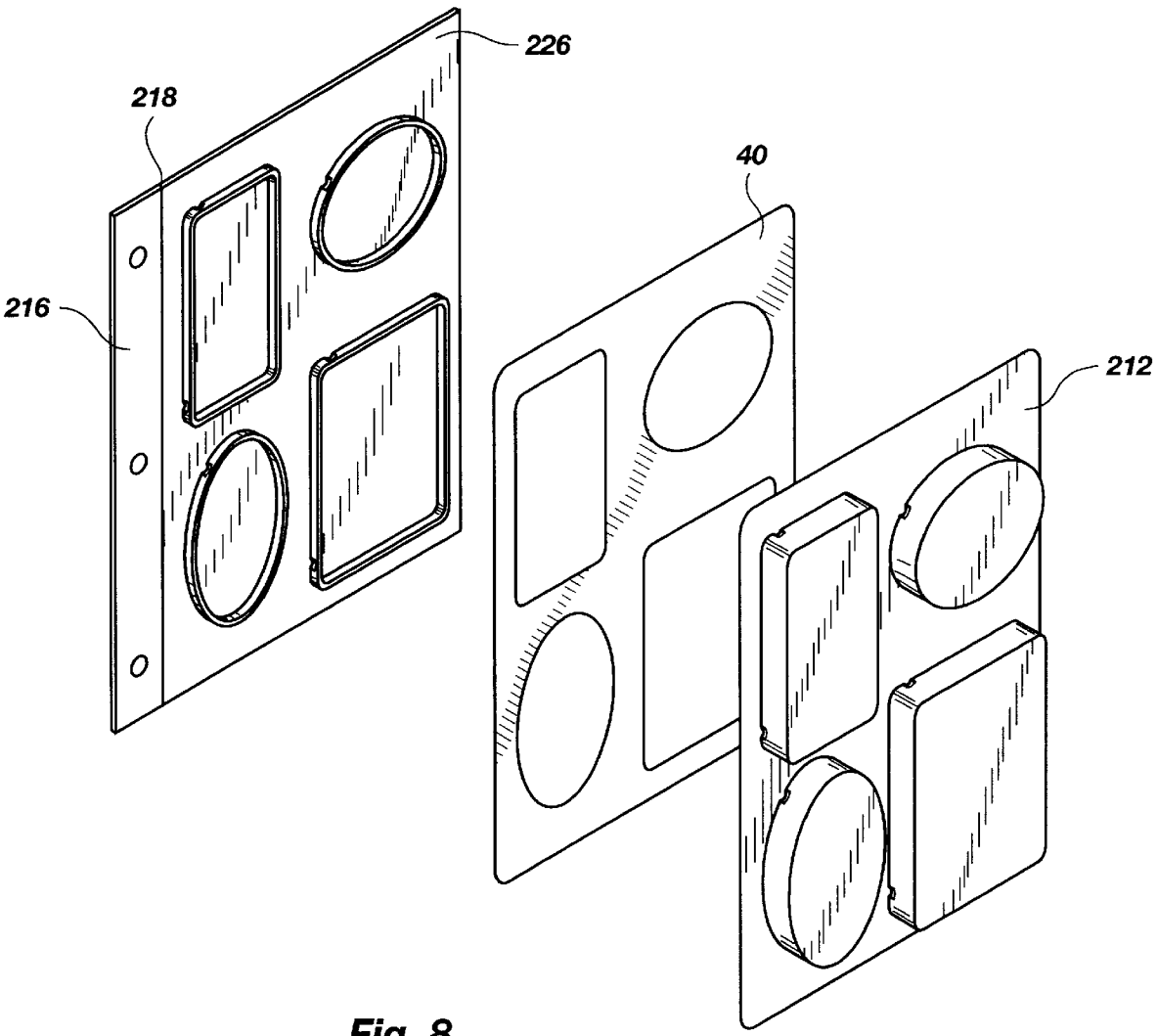
FIG. 8 is a perspective exploded view illustrating a third embodiment of a storage page of the present invention.

FIG. 8 is a perspective view similar to FIG. 2 that illustrates a third embodiment of the present invention. Essentially, all of the aspects of the third embodiment of FIG. 8 are identical to the corresponding aspects of the first embodiment of FIG. 2, except that the front planar section 212 is not formed with a binding tab. Rather, the left side of the front planar section 212 is straight. In addition, the back planar section 226 is formed with a binder tab 216 for use with a post-type binder. Specifically, the binder tab 216 includes a living hinge 218 formed between the binder tab and the planar portion of the back planar section 226 that enables the back planar section (and of course, the attached front planar section) to fold at the living hinge 218, so that the binder tab 216 can be stationarily bound in a post-type binder. This embodiment will also accommodate an opaque matte 40.

Figure 9:
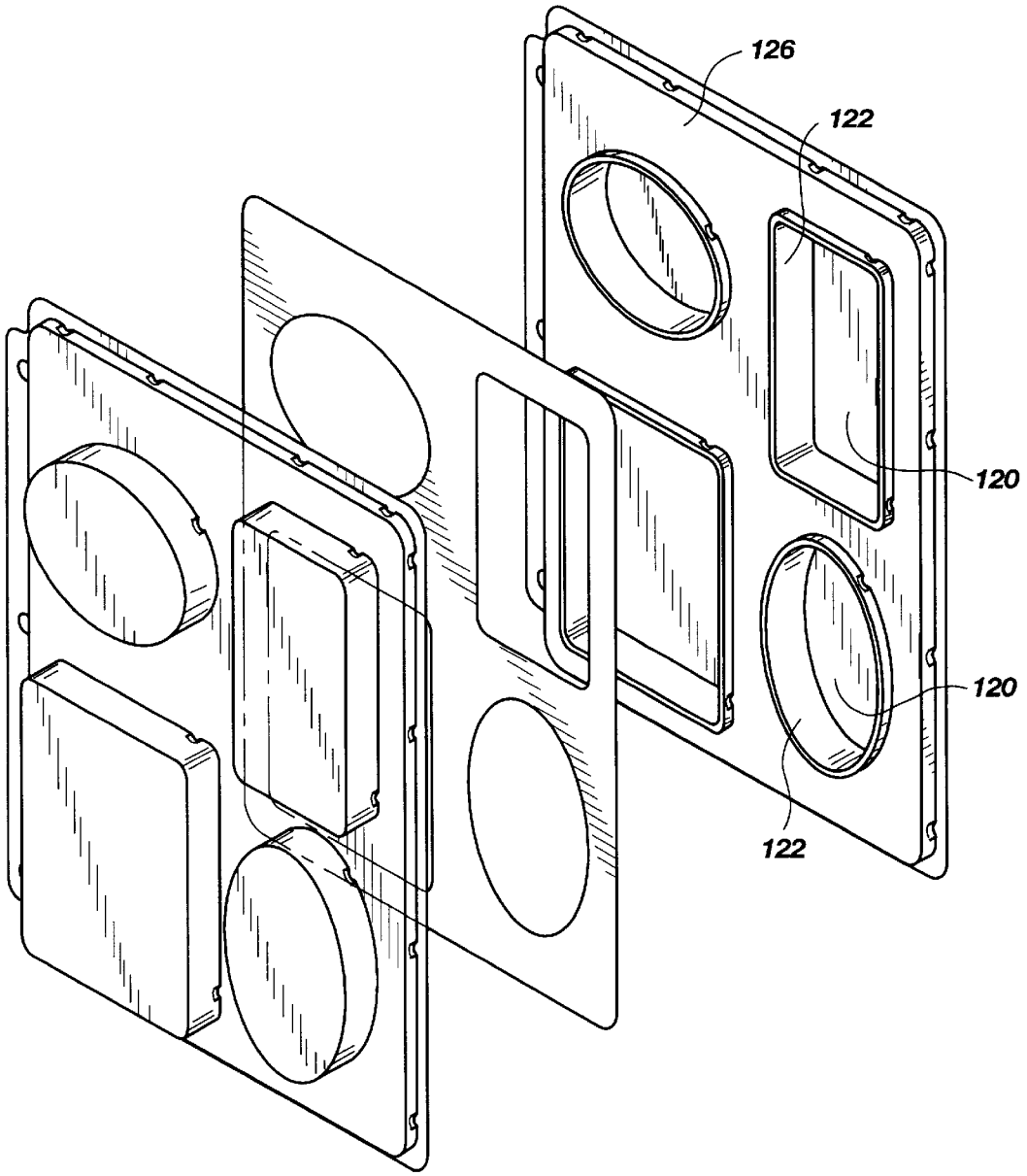
FIG. 9 is a perspective exploded view illustrating a fourth embodiment of a storage page of the present invention.

FIG. 9 is a perspective view similar to FIG. 2 that illustrates a fourth embodiment of the present invention. Specifically, all of the component and elements of the FIG. 9 embodiment are identical to corresponding ones of the FIG. 2 embodiment, except for the depth of the various three-dimensional pockets formed in the back planar section 126. In this embodiment, each three-dimensional cavity is essentially twice as deep as those in the FIG. 2 embodiment, due to the fact that the back planar section incorporates three-dimensional pockets similar to the manner in which the front planar section incorporates the three-dimensions into the pockets. Specifically, the three-dimensional pockets defined in the back section include lowered cavity planar rear walls 120 and corresponding side walls 122 that define three-dimensional pockets formed on the back side of the back planar surface 126, also, thus essentially doubling the "depth" of the three-dimensional cavities.

Figure 10:
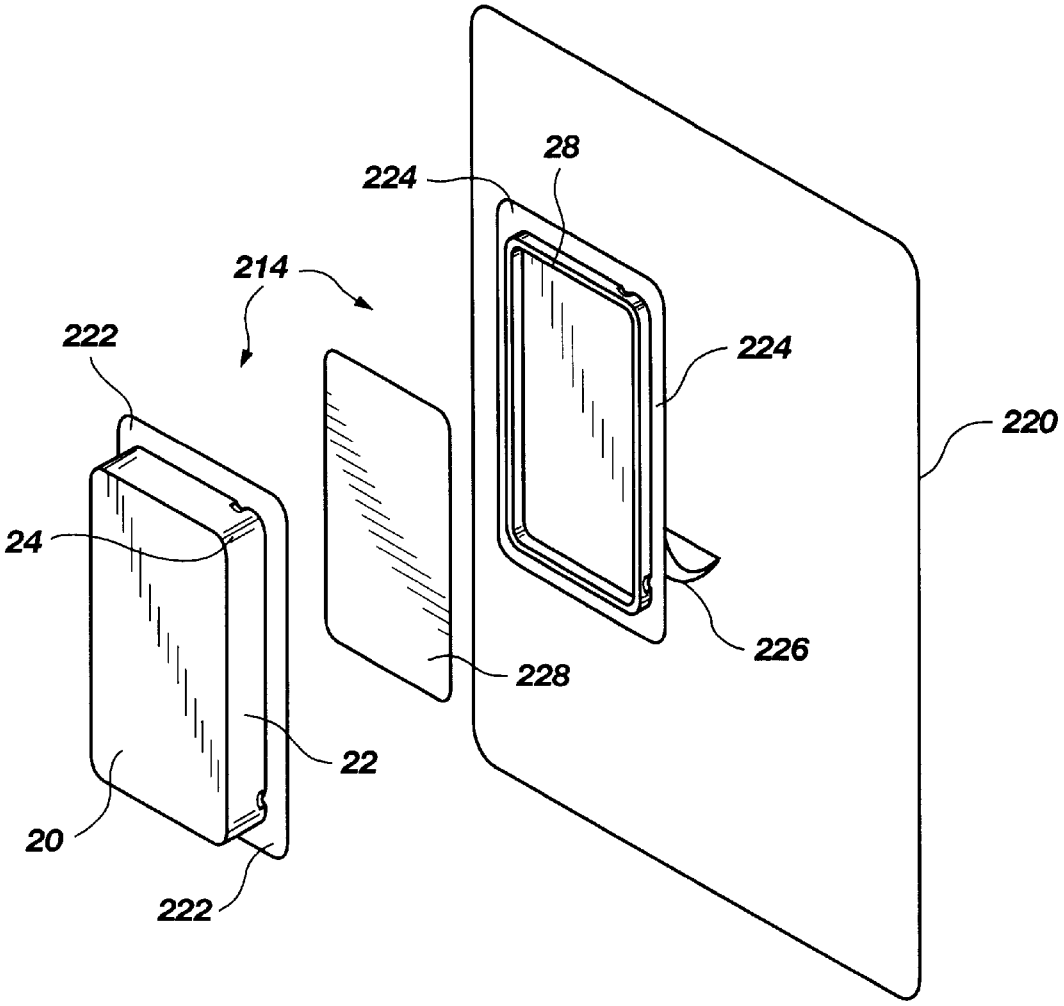
FIG. 10 is a perspective exploded view illustrating a fifth embodiment of a storage page of the present invention.

FIG. 10 illustrates a fifth embodiment of the storage page of the present invention. Specifically, the fifth embodiment comprises one or more individual three-dimensional cavities 214 that are essentially identical to the three-dimensional cavities previously described. In this embodiment, however, the three-dimensional cavities are independent, and are adapted to peal-and-stick directly onto a separate backing plate 220, for instance, for use with a three-dimensional ring binder or post-binder. In this embodiment, the backing plate 220 may be formed of a cardboard or plastic material, and may be clear or opaque, the only criterion being that the backing material be sufficiently rigid to support one or more three-dimensional cavities.

The three-dimensional cavity 214 of this fifth embodiment comprises a planar front wall 20, planar side walls 22 that intersect in corners 24, as in the previously described embodiments. The three-dimensional cavity of this fifth embodiment, however, does not include the planar sheet section defining the storage page, but rather includes a narrow lip 222 around the plurality of side walls 22 for purposes of maintaining the rigidity and structural integrity of the three-dimensional cavity.

Likewise, the back portion of the individual three-dimensional cavity includes the cooperating raised ledges 28 as in the previously described three-dimensional cavities. It does not include the generally planar section, however, but rather includes only a perimeter lip 224 around the raised ledges 28, again to maintain the rigidity and structural integrity of the raised ledges 28 and back planar surface of the three-dimensional cavity. In addition, this fifth embodiment includes a self-stick adhesive material (not shown) and peel back cover 226 on the back side of the back planar section of the cavity to enable it to be stuck directly onto the backing page or sheet 220. In this manner, a plurality of three-dimensional cavities can be custom-positioned on a backing plate for forming customized storage pages.

In addition, those skilled in the art will readily appreciate that the three-dimensional cavity 214 shown in the fifth embodiment is not limited to attachment onto backing plates for binder-type storage pages. Rather, the fifth embodiment three-dimensional cavity may be positioned on backing plates for mounting within picture frames, for instance, and also may be mounted directly on walls, doors, mirrors, etc. for holding and displaying three-dimensional objects in plain and open view, as opposed to in binders, photo albums, or the like.

Lastly, all of the three-dimensional binders of the present invention may include cavity mattes 228 sized and configured to fit inside the three-dimensional cavities. The preferred material for these cavity mattes is the same as the opaque matte 40, a Ph-neutral paper stock. The cavity mattes may be positioned directly in the specific three-dimensional cavity for purposes of contrast or accenting the contents of the particular three-dimensional cavity.

From the foregoing it will be seen that this invention is one well adapted to attain all of the ends and objectives herein set forth, together with other advantages which are obvious and which are inherent to the composition and method. It will be understood that certain features and subcombinations are of utility and may be employed with reference to other features and subcombinations. This is contemplated by and is within the scope of the claims. As many possible embodiments may be made of the invention without departing from the scope of the claims. It is to be understood that all matter herein set forth or shown in the accompanying drawings is to be interpreted as illustrative and not in a limiting sense.

What is claimed is:

1. A storage page having a three-dimensional cavity for storing and displaying three-dimensional objects, the storage page comprising:

a first sheet of semi-rigid material having a three-dimensional pocket formed therein, the pocket having a transparent front wall and a side wall depending from the front wall;

a second sheet of semi-rigid material having a raised section extending essentially normal to the second sheet, the raised section sized and configured to snugly fit inside the first sheet three-dimensional pocket against the first sheet three-dimensional pocket side wall; and connecting means for connecting the first sheet three-dimensional pocket to the second sheet raised section and maintaining the connection therebetween to define the three-dimensional cavity, the connection means comprising:

means defining an indentation formed in the second sheet raised section; and a projection formed in the first sheet three-dimensional pocket side wall that is in registration with, and insertable into, the second sheet raised section indentation, in order to removably retain the second sheet raised section and first sheet three-dimensional pocket together.

2. A storage page as set forth in claim 1, further comprising a third sheet of opaque matte material positioned between the first and second sheets, the third sheet having means defining an aperture in registration with the first sheet three-dimensional pocket and second sheet raised section.

3. A storage page as set forth in claim 2, wherein the opaque matte is colored.

4. A storage page as set forth in claim 2, wherein the opaque matte can be written on.

5. A storage page as set forth in claim 1, further comprising a pocket matte made of opaque material of a size and configuration to fit inside the first sheet three-dimensional pocket and the second sheet raised section.

6. A storage page as set forth in claim 5, wherein the pocket matte is colored.

7. A storage page as set forth in claim 1, wherein the second sheet is opaque.

8. A storage page as set forth in claim 1, wherein the three-dimensional pocket sidewalls are transparent.

9. A storage page as set forth in claim 1, wherein the three-dimensional pocket sidewalls are opaque.

10. A storage page as set forth in claim 1, wherein the first or second sheet includes a tab essentially co-planar therewith along one edge thereof, the tab including at least one mounting hole therein.

11. A storage page as set forth in claim 10, wherein the tab is connected to said one edge thereof by hinge means.

12. A storage page as set forth in claim 1, wherein the first and second sheets are connected together along an adjacent edge thereof by hinge means.

13. A storage page as set forth in claim 1, further comprising ring binder holding means for holding the storage page in a ring binder.

14. A storage page as set forth in claim 1, further comprising post binder holding means for holding the storage page in a post binder.

15. A storage page as set forth in claim 1, wherein the second sheet raised section defines a three-dimensional pocket that combines and cooperates with the first sheet three-dimensional pocket to define a storage page three-dimensional cavity extending from both the front of the first sheet and the back of the second sheet.

* * * * *